US006149532A

United States Patent [19]

Kim

[11] Patent Number: 6,149,532

[45] Date of Patent: Nov. 21, 2000

[54] GOLF BALL IMPACT DETECTION SYSTEM FOR IMPROVING A GOLF SWING

[76] Inventor: Cheol K. Kim, 175 Solana Dr., Los Altos, Calif. 94022

[21] Appl. No.: 09/312,703

[22] Filed: May 17, 1999

Related U.S. Application Data

[63] Continuation-in-part of application No. 09/098,177, Jun. 16, 1998.

[51] Int. Cl.[7] ..... A63B 69/36

[52] U.S. Cl. ..... 473/221; 473/268

[58] Field of Search ..... 473/199, 209, 473/211, 190, 266, 268, 220, 221, 409, 406, 407, 422; 434/252

[56] References Cited

U.S. PATENT DOCUMENTS

| | | | |
|---|---|---|---|
| 3,992,011 | 11/1976 | Jessee | 473/220 |
| 4,180,726 | 12/1979 | DeCrescent | 250/222 R |
| 4,560,167 | 12/1985 | Perreau et al. | 273/184 R |
| 5,338,036 | 8/1994 | Takeuchi et al. . | |
| 5,375,832 | 12/1994 | Witler et al. | 273/184 R |
| 5,401,026 | 3/1995 | Eccher et al. | 273/184 R |
| 5,437,457 | 8/1995 | Curchod | 273/185 A |
| 5,479,008 | 12/1995 | Nishiyama et al. | 250/222.1 |
| 5,527,036 | 6/1996 | Huchings et al. | 473/220 |
| 5,527,041 | 6/1996 | Terry, III et al. | 473/150 |
| 5,553,857 | 9/1996 | Fish . | |
| 5,558,585 | 9/1996 | Nolan, Jr. . | |
| 5,599,239 | 2/1997 | Kim et al. . | |
| 5,694,340 | 12/1997 | Kim | 364/566 |

*Primary Examiner*—Kien T. Nguyen
*Attorney, Agent, or Firm*—Burns Doane Swecker & Mathis L.L.P.

[57] ABSTRACT

A golf ball impact detection system to assist a golfer in reducing premature head-up movement. The impact detection system includes a sound detection device for detecting an impact sound of a club head with a golf ball and a light source which turns on immediately upon detection of the impact sound. When the impact sound is detected, an electrical circuit processes the impact sound signal and turns on the light source for a predetermined time. A short light flash is intended when the golfer uses a driver or iron club, while a longer light flash is for putter or pitching wedge applications. A day or night selection switch is provided for the altering between daytime or nighttime applications. The flash of the light source encourages a golfer to keep his head down after the club head strikes the golf ball, thereby reducing premature head-up movement, since the golfer will wait to see the light flash before looking up to see his shot.

27 Claims, 4 Drawing Sheets

GOLF BALL IMPACT DETECTION SYSTEM FOR IMPROVING A GOLF SWING

CROSS-REFERENCE TO RELATED APPLICATION

This application is a continuation-in-part of U.S. Ser. No. 09/098,177, filed on Jun. 16, 1998 still pending.

BACKGROUND OF THE INVENTION

1. Field of the Invention

The invention relates to a system that assists a golfer in reducing premature head-up movement.

2. Brief Description of the Related Art

The game of golf is one of the most popular sports in the United States and is enjoyed around the world. In golf, as in other sports, it is desirable that the golfer be able to repeat an ideal swing in order to improve the golfer's game performance. Beginners are instructed to keep their heads steady and to maintain eye contact with the golf ball up through the moment the golf club strikes the ball. This practice enables the golfer to focus on the golf ball and thereby hit the golf ball correctly. Frequently, golfers will lift their heads too early while swinging a golf club, and thus their eyes turn away from the golf ball too soon.

Typically, an instructor will observe and correct the student's premature head-up movement. However, such instruction is expensive, and many students will practice poor golfing habits, such as premature head-up movements, when the instructor is not present, and that will ultimately become part of the golfer's swing. Further, when practicing alone, the subsequent flight of the golf ball does not provide enough feedback to the golfer as to the correctness of his head position during the golf swing.

One example of a golf exercise aid is disclosed in U.S. Pat. No. 5,553,857 to Fish. The processor of Fish detects and stores into a memory, multiple movements and events which requires a complex and expensive processor. Another example of a golf exercise aid is disclosed in U.S. Pat. No. 5,338,036 to Takeuchi, et al. This device comprises a sound pickup means for detecting an impacting sound, a first means which compares a waveform within a predetermined frequency band with a threshold value, a motion sensor made up of an earth magnetic field sensor or an angular velocity sensor, and a second means which rectifies and then differentiates the output signal of the motion sensor. Although the device of Takeuchi, et al. notifies the user of head-up movement, the device is attached to the player and requires the monitoring and measuring of multiple events.

SUMMARY OF THE INVENTION

The present invention relates to a golf impact detection system to assist a golfer in reducing premature head-up movement.

In accordance with one aspect of the present invention, a golf ball impact detection system includes a means for detecting sound caused by an impact of a club head with a golf ball, a light source, a signal amplification means connected to the sound detection means with gain control and to the light source, and an on-time light source control. When the system detects the impact sound of a club head against a golf ball, the on-time light source control enables the light source to turn on and then turn off for a predetermined amount of time. Such a flash of light helps golfers to keep their heads down while swinging their club heads, thereby reducing premature head-up movement, since the golfers will wait to see the light flash before looking up.

In accordance with an additional aspect of the present invention, a method of detecting the impact sound of a club head with a golf ball wherein a light source turns on when a sound detector means detects the impact sound of a club head against a golf ball. When the system detects the impact sound of a club head with a golf ball, a signal amplification means, connected to the sound detector means, passes a signal to the light source to turn on. The light source has adjustable on-time capability, as well as adjustable brightness capability. Further, the signal amplification means includes a preamplifier with adjustable gain capability such that the golfer can adjust the audio sensitivity of the sound detector means by adjusting the gain control mechanism. Such means for affecting the audio sensitivity of the sound detection means can be used to adjust the on-time for said light source.

In accordance with a further embodiment of the present invention, a system to assist a user to keep his eyes focused while using sporting equipment. The system includes a means for detecting sound caused by the impact of sporting equipment with a ball, a light source, a signal amplification means connected to the sound detection means and to the light source, and an on-time light source control. When the system detects the impact sound of sporting equipment with a ball, the on-time light source control enables the light source to turn on and then turn off for a predetermined amount of time. Such a flash of light helps the user keep his head steady while swinging his sports equipment, since the user will wait to see said light source turn on and then turn off before looking.

The present invention provides advantages of detecting the impact sound of a club head with a golf ball, wherein upon detection of this sound, the system simply illuminates a light source to help the person focus on the point of contact between the club and ball, thereby reducing premature head-up movement. The golf ball impact detection system does not require attaching said detection system to the golfer, wherein the weight or placement of such attachment may be distracting for the golfer.

BRIEF DESCRIPTION OF THE DRAWINGS

The present invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The golf ball impact detection system assists a golfer in reducing premature head-up movement. Typically, the golf ball impact detection system 10 is placed on the ground near the golf ball, and this system operates to detect the sound of a club head contacting a golf ball, thereby causing a light source 14 to turn on for a predetermined duration of time. This light helps golfers maintain their focus after striking the ball. By keeping their heads down during their swing and waiting to see this flash of light, golfers can avoid premature head-up movement.

Figure 1:
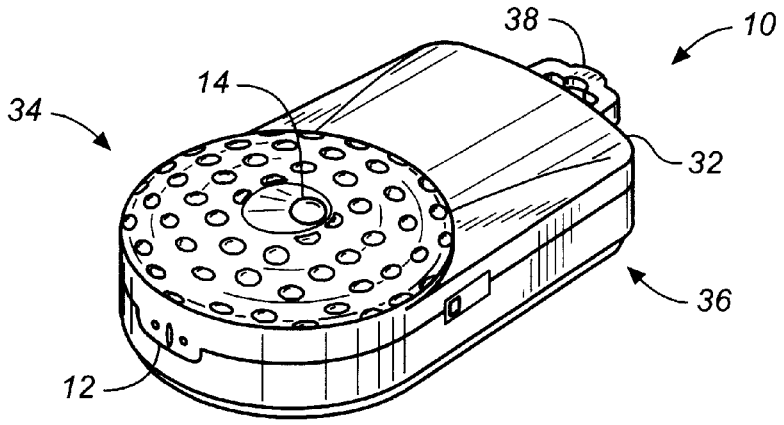
FIG. 1 is a perspective view of a golf ball impact detection system in accordance with the present invention.
Figure 2:
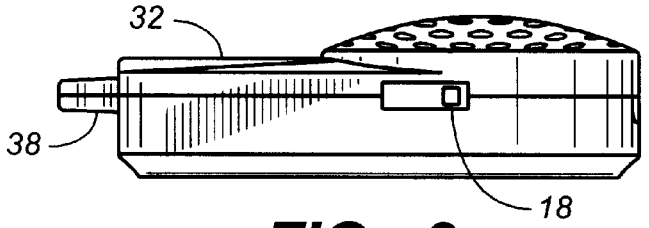
FIG. 2 is a side view of the embodiment of FIG. 1.
Figure 3:
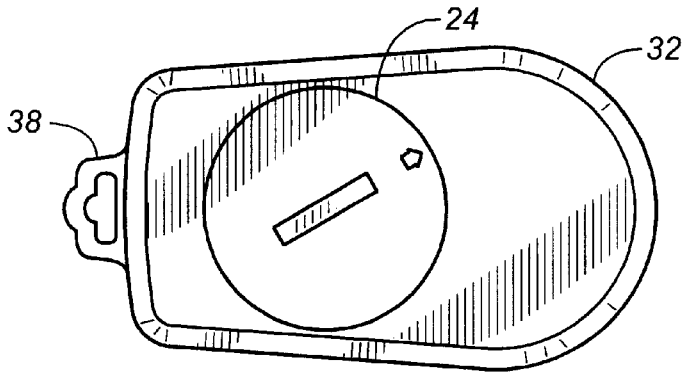
FIG. 3 is a bottom view of the embodiment of FIG. 1.

FIGS. 1–3 show a system 10 for detecting the impact sound of a club head with a golf ball, the system 10 having an opening 12 in communication with a sound sensing device, a light source 14, a gain control mechanism 18, and a battery, all of which are enclosed within a protective housing 32. The housing 32 has a first end 34 and a second end 36. A handle 38, positioned at the second end 36, allows a golfer to easily carry the golf ball impact detection system 10 or to clip the impact detection system 10 to a key chain. Further, the opening 12 is positioned at the first end 34, opposite the handle 38, such that the handle will not block or interfere with the sound sensing device.

Figure 4A:
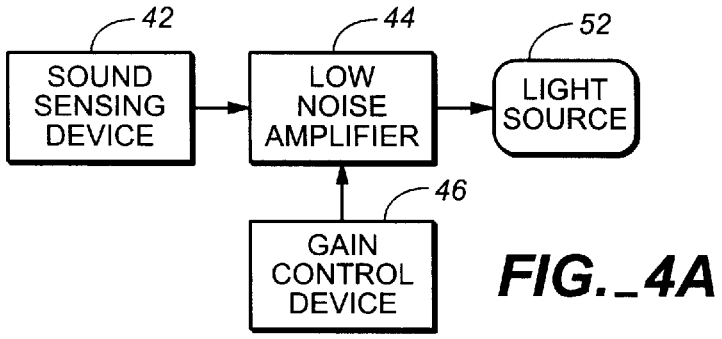
FIG. 4A is a block diagram of a golf ball impact detection system according to first embodiment of the present invention.

Generally, as illustrated in FIG. 4A, the golf ball impact detection system 10 includes a sound sensing device 42 which detects the impact sound of a club head against a golf ball. In operation of the system 10, the sound sensing device 42 detects the impact sound and generates an electrical signal which a signal amplification means 44, such as a low noise amplifier, having a gain control device 46, amplifies and then passes to a light source 52. The golfer can select the audio sensitivity of the impact detection system 10 by adjusting the gain control device 46. If the gain control device 46 is adjusted for high sensitivity, then the golf ball impact detector system 10 can detect a low sound, for example when a golfer is using a putter to strike a golf ball. Alternatively, the gain control device 46 can be adjusted for a low gain when the golf ball impact detector system 10 is detecting a loud sound, for example when the golfer is using a driver or iron club to strike the golf ball. Thus, the golf ball impact detection system 10 can distinguish the impact sound of a putter club head with a golf ball from a driver or iron club head against said golf ball.

When the sound detected by the sound sensing device 42 is above a predetermined level, an output signal is transmitted from the low noise amplifier 44 to trigger a light source 52 such that the light source is turned on.

Figure 4B:
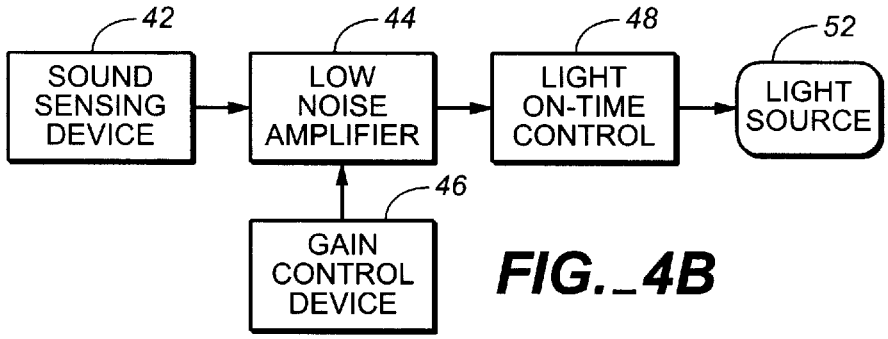
FIG. 4B is a block diagram of the golf ball impact detection system according to a second embodiment.

FIG. 4B shows the general block diagram of a second embodiment of the golf ball impact detection system including an optional light on-time control 48 which regulates the duration that said light source 52 is "on," i.e., illuminated. The optional light on-time control 48 can be adjustable such that the light source 52 can have a longer or shorter on-time. A longer on-time duration of the light source is in the range of about 0.2 to about 1.0 seconds, and more particularly about 0.3 to about 0.4 seconds. A shorter on-time duration of the light source is in the range of about 0.05 to about 0.2 seconds, and more particularly about 0.1 to about 0.15 seconds.

Figure 4C:
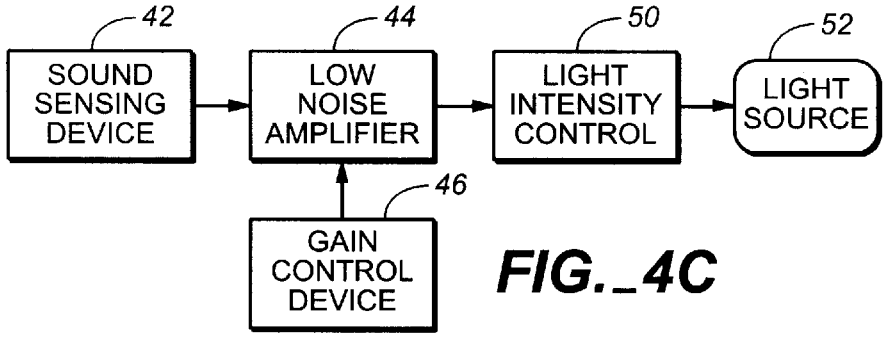
FIG. 4C is a block diagram of the golf ball impact detection system according to a third embodiment.

FIG. 4C shows the general block diagram of a third embodiment of the golf ball impact detection system including an optional light intensity control 50 which regulates the brightness of said light source 52. Accordingly, if the golf ball impact detection system 10 is used outdoors during the daytime, when there is bright ambient light, then the golfer can select the light source 52 to flash a bright light. On the other hand, if the golf ball impact detection system 10 is used indoors or during the nighttime when the ambient light is low, then the light source 52 can be set to flash a dimmer light.

Figure 4D:
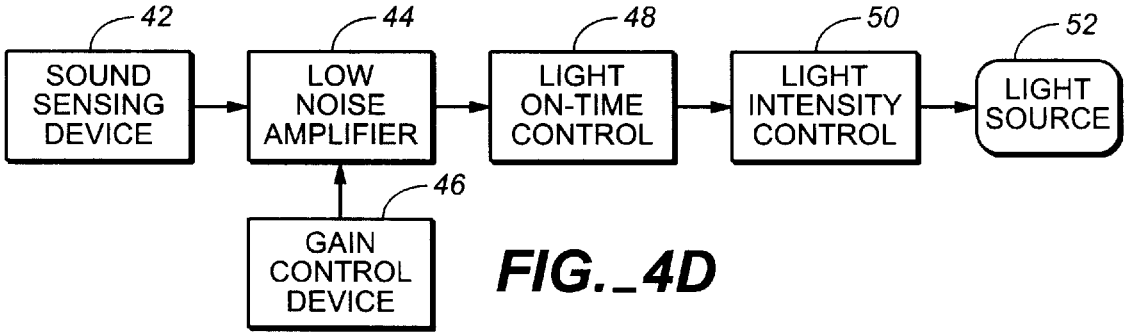
FIG. 4D is a block diagram of the golf ball impact detection system according to a fourth embodiment.

FIG. 4D depicts the general block diagram of a fourth embodiment of the golf ball impact detection system including the optional light on-time control 48 and the optional light intensity control 50. In the fourth embodiment, the golfer can adjust the duration that the light source will turn on and can adjust the brightness in which the light source will flash.

Figure 5:
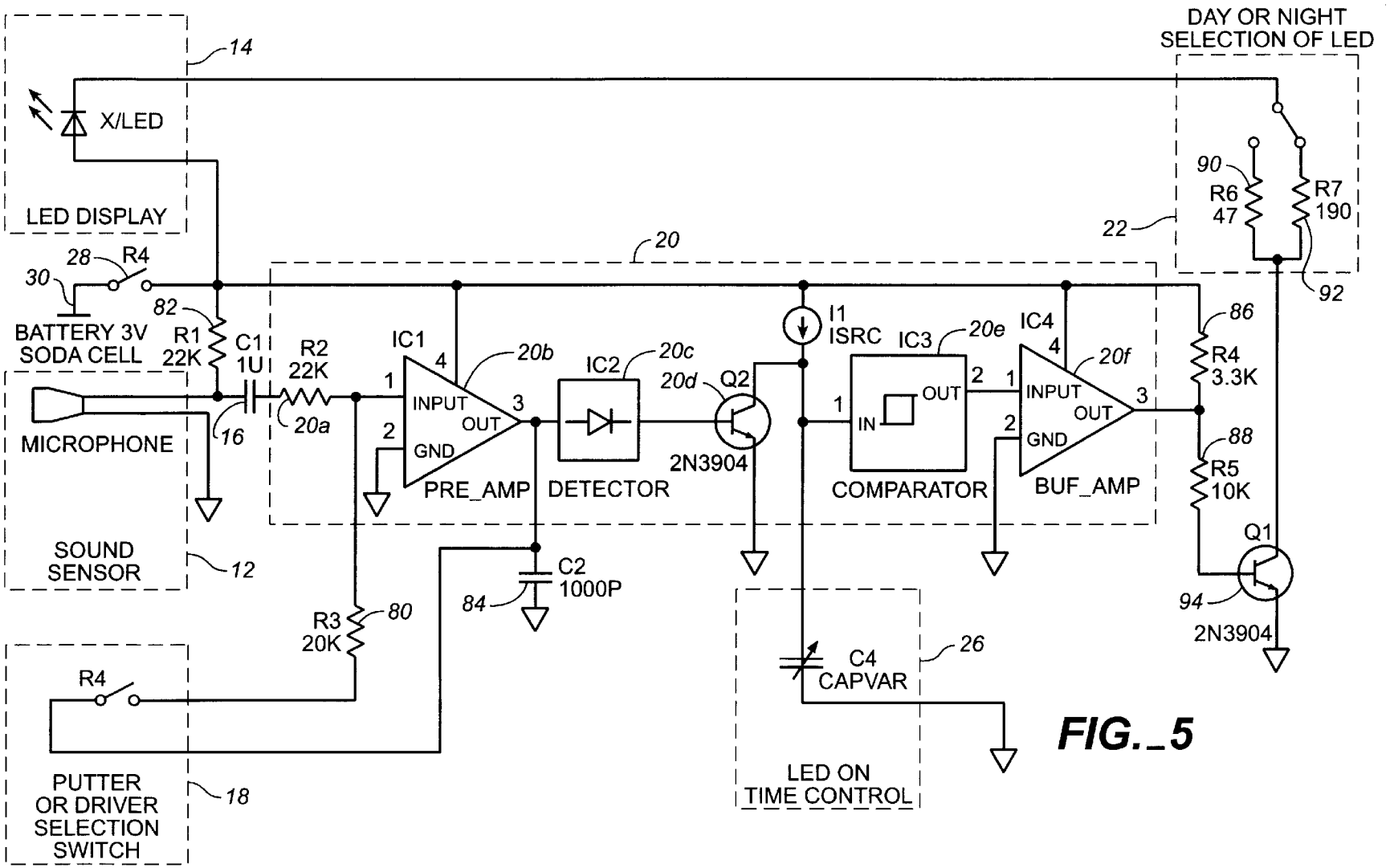
FIG. 5 is a schematic view of one embodiment of FIG. 4D of the golf ball impact detection system.

In one embodiment of a circuit for implementing the golf ball impact detection system 10 of FIG. 4D, as shown in FIG. 5, the impact detection system includes a sound sensing device 42, or microphone, which detects the impact sound of a club head with a golf ball. In practice, the sound sensing device 42 is a conventional microphone. The microphone 42 detects the impact sound and generates an electrical signal which passes through a capacitor 16 which blocks direct current (DC).

The capacitor 16 is connected to an integrated circuit chip 20, which includes hardware and/or software which amplifies, with adjustable gain capability, the electrical signal from the microphone 42 and then converts the amplified signal from an alternating current to a DC signal. The integrated circuit chip comprises a resistor 20*a*, a preamplifier 20*b*, a detector 20*c*, a transistor 20*d*, a comparator 20*e*, and a buffer amplifier 20*f*. In practice, the integrated circuit chip 20 is a monolithic integrated circuit designed for signal level sensor systems. Preferably, the integrated circuit chip 20 provides low power, low voltage operation, and high input sensitivity.

In operation of the circuit, the electrical signal introduced into the integrated circuit chip 20 is amplified by the preamplifier 20*b*. The preamplifer 20*b* has an adjustable gain, wherein the golfer can select the audio sensitivity of the impact detection system 10 by moving a switch 18 to adjust the gain of the preamplifier in the integrated circuit chip 20. If the impact detection system 10 is needed to detect a low sound, for example when a golfer is using a putter to strike the golf ball, then a high gain in the preamplifier 20*b* is desired. Alternatively, if the impact detection system 10 is needed to detect a large impact sound, for example when the golfer is using a driver or iron club to hit a golf ball, then a low gain in the preamplifier 20*b* is preferred. Accordingly, the golfer can close the switch 18*a* to select a lower sensitivity for the impact detection system 10 wherein the circuit includes the resistor 80. The preamplifier 20*b* in the integrated circuit chip 20 has a gain sufficient to detect a minimum sound level of a putter striking a golf ball. It will be understood by one skilled in the art that the switch 18 generally corresponds to the gain control device 46 of FIGS. 4A–4D, and the preamplifier 20*b* generally corresponds to the low noise amplifier 44.

The preamplifier 20*b* is connected to a detector 20*c* and a capacitor 84. The detector 20*c* converts the amplified signal from an alternating current signal to a DC signal, and the signal is then fed to a transistor 20*d*. The function of the transistor 20*d* is to activate an on-time control means 26 which turns on and turns off a light source 14, such as a light emitting diode or lightbulb. The on-time control means 26 for turning on and turning off said light source 14 may include any suitable means, but in the preferred embodiment, this controlling means includes a capacitor 26*a*.

When the DC signal level of the detector 20*c* is above a predetermined level, for example, 0.64 volts, the transistor 20*d* turns on, and the capacitor 26*a* discharges through said transistor. The voltage across the capacitor 26*a*, which is initially charged to the supply voltage, for example 3.0 volts, starts to fall below a preset reference voltage, for example, 1.0 volt, at which time the output of the comparator 20*e* changes from high state to low state. The buffer amplifier 20*f* acts as an inverter, and the output of the buffer amplifier 20*f* goes to high state. The output signal of the buffer amplifier 20*f* is transmitted from the integrated circuit chip 20 to resistors 86, 88 and to transistor 94. The transistor 94 is turned on which enables the light source 14 to turn on. The voltage decay rate of the capacitor 26*a* controls the on-time of the light source 14. This controlling means 26 for turning on and then turning off said light source may alternatively comprise any other suitable means, including but not limited to an electrical counter.

It will be understood that by varying the capacitor 26*a* value, therein altering the voltage decay rate, the light source 14 will have a longer or shorter on-time. Further, the golfer can affect the duration that the light source 14 is turned on by adjusting the gain of the preamplifier 20*b*. Wherein, if the golfer desires that the light source 14 have a longer on-time, for example during putting, then a larger gain is desired. Accordingly, a light source 14 having a longer on-time will help the golfer's eyes stay focused on the golf ball up through the moment the golf club strikes the ball and thereby reduce premature head-up movement. Further, it will be understood by one skilled in the art that the on time control means 26 generally corresponds to the light on-time control 48 of FIGS. 4A–4D.

Further in the circuit, the transistor 94 is connected to a switch 22. The switch 22 allows the golfer to select the brightness of the light emitting diode 14. In operation, a golfer can set the switch 22 to choose between at least two resistors 90, 92, each having a different resistance value. The brightness or intensity of light is generally determined by the resistor value. The brightness of the light emitting diode 14 can be increased by simply moving the switch 22 to select the desired resistor. If the golf ball impact detection system 10 is used outdoors and during the daytime, when there is bright ambient light, then the golfer will want to set the light emitting diode 14 for a bright flash. Accordingly, the golfer can select the smaller value resistor 92 by moving the switch 22. Similarly, if the golf ball impact detection system 10 is used indoors or during the nighttime, when the ambient light is low, then a larger value resistor 90 is desired. It will be understood by one skilled in the art that the switch 22 generally corresponds to the light intensity control 50 of FIGS. 4C and 4D.

Figure 6:
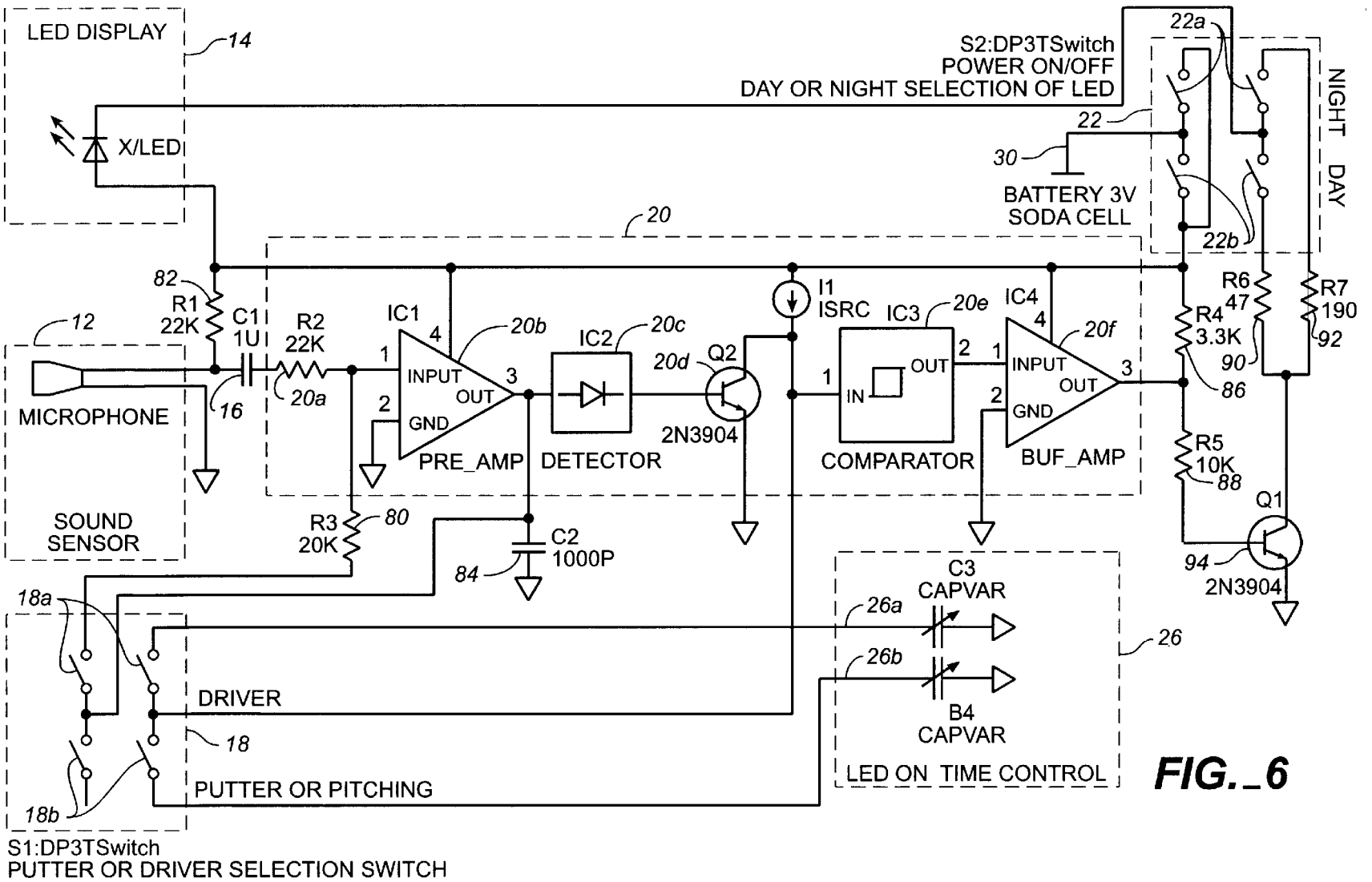
FIG. 6 is a schematic view of another embodiment of FIG. 4D of the golf ball impact detection system.

In a preferred embodiment of a circuit for implementing the golf ball impact detection system 10 of FIG. 4D, as shown in FIG. 6, the impact detection system includes a sound sensing device 42 which detects the impact sound of a club head with a golf ball. In practice, the sound sensing device 42 is a conventional microphone. The microphone 42 detects the impact sound and generates an electrical signal which passes through a capacitor 16 which blocks direct current (DC).

The capacitor 16 is connected to an integrated circuit chip 20, which includes hardware and/or software which amplifies, with adjustable gain capability, the electrical signal from the microphone 42 and then converts the amplified signal from an alternating current signal to a DC signal. The integrated circuit chip 20 comprises a resistor 20*a*, a preamplifier 20*b*, a detector 20*c*, a transistor 20*d*, a comparator 20*e*, and a buffer amplifier 20*f*. In practice, the integrated circuit chip 20 is a monolithic integrated circuit designed for signal level sensor systems. Preferably, the integrated circuit chip 20 provides low power, low voltage operation, and high input sensitivity.

In operation of the circuit, the electrical signal introduced into the integrated circuit chip 20 is amplified by the preamplifier 20*b*. The preamplifer 20*b* has an adjustable gain, wherein the golfer can select the audio sensitivity of the impact detection system 10 by moving a switch 18 to adjust the gain of the preamplifier in the integrated circuit chip 20. If the impact detection system 10 is needed to detect a low sound, for example when a golfer is using a putter to strike the golf ball, then a high gain in the preamplifier 20*b* is desired. Accordingly, the golfer can close the switch 18*b* to select a higher sensitivity for the impact detection system 10. Alternatively, if the impact detection system 10 is needed to detect a large impact sound, for example when the golfer is using a driver or iron club to hit a golf ball, then a low gain in the preamplifier 20*b* is preferred. The preamplifier 20*b* in the integrated circuit chip 20 has a gain sufficient to detect a minimum sound level of a putter striking a golf ball. It will be understood by one skilled in the art that the switch 18 generally corresponds to the gain control device 46 of FIGS. 4A–4D, and the preamplier 20*b* generally corresponds to the low noise amplifier 44. The switch 18 may comprise any suitable means, including but not limited to a double-pole, triple-draw switch, wherein at a first pole 18*a*, a low gain in the preamplifier 20*b* is selected, and at a second pole 18*b*, a high gain in the preamplifier 20*b* is selected. Moreover, when the first pole 18*a* is selected, the circuit includes the resistor 80.

The preamplifier 20*b* is connected to a detector 20*c* and a capacitor 84. The detector 20*c* converts the amplified signal from an alternating current signal to a DC signal, and the signal is then fed to a transistor 20*d*. The function of the transistor 20*d* is to activate a controlling means 26 which turns on and turns off a light source 14, such as a light emitting diode or lightbulb. A controlling means 26 for turning on and turning off said light source 14 may include any suitable means, but in the preferred embodiment, this controlling means includes at least one capacitor (two capacitors 26*a*, 26*b* are shown).

When the DC signal level of the detector 20*c* is above a predetermined level, for example, 0.64 volts, the transistor 20*d* turns on, and the capacitor 26*a* or 26*b* discharges through said transistor. The voltage across the capacitor 26*a*, 26*b* which is initially charged to the supply voltage, for example 3.0 volts, starts to fall below a preset reference voltage, for example, 1.0 volt, at which time the output of the comparator 20*e* changes from high state to low state. The buffer amplifier 20*f* acts as an inverter, and the output of the buffer amplifier 20*f* goes to high state. The output signal of the buffer amplifier 20*f* is transmitted from the integrated circuit chip 20 to resistors 86, 88 and to transistor 94. The transistor 94 is turned on which enables the light source 14 to turn on. The voltage decay rate of the capacitor 26*a*, 26*b* controls the on-time of the light source 14. This controlling means 26 for turning on and then turning off said light source may alternatively comprise any other suitable means, including but not limited to an electrical counter.

It will be understood that by varying the capacitor 26*a*, 26*b* value, therein altering the voltage decay rate, the light source 14 will have a longer or shorter on-time. The golfer can select the capacitor discharge time of the impact detection system 10 by moving a switch to adjust the capacitor value of the controlling means 26. If the golfer desires that the light source 14 have a longer on-time, for example during putting, then a larger capacitor value is desired. Accordingly, a light source 14 having a longer on-time will help the golfer's eyes stay focused on the golf ball up through the moment the golf club strikes the ball and thereby reduce premature head-up movement. Further, it will be understood by one skilled in the art that the controlling means 26 generally corresponds to the light on-time control 48 of FIGS. 4A–4D.

In one embodiment of the present invention, the switch 18 used for selecting the audio sensitivity can be used to select the capacitor value of the controlling means 26, thereby controlling the on-time of the light emitting diode 14. Thus, if the golfer selects a higher audio sensitivity for the impact detection system 10, for example, when said golfer is using a putter to strike the golf ball, the system 10 is also adjusted for a longer on-time of the light emitting diode 14.

Further in the circuit, the transistor 94 is connected to a switch 22. The switch 22 allows the golfer to select the brightness of the light emitting diode 14. In operation, a golfer can set the switch 22 to choose between at least two resistors 90, 92, each having a different resistance value. The brightness or intensity of light is generally determined by the resistor value. The brightness of the light emitting diode 14 can be increased by simply moving the switch 22 to select the desired resistor. If the golf ball impact detection system 10 is used outdoors and during the daytime, when there is bright ambient light, then the golfer will want to set the light emitting diode 14 for a bright flash. Accordingly, the golfer can select the smaller value resistor 92 by closing the switch 22*b*. Similarly, if the golf ball impact detection system 10 is used indoors or during the nighttime, when the ambient light is low, then a larger value resistor 90 is desired. It will be understood by one skilled in the art that the switch 22 generally corresponds to the light intensity control 50 of FIGS. 4C and 4D.

As illustrated in FIGS. 1–3, 5 and 6, the protective housing 32 surrounds the golf ball impact detector system 10. The switch 22 activates the golf ball impact detection system 10. A battery 30, positioned behind the battery cover 24, provides the necessary power source. In the exemplary golf ball impact detection system 10, the battery 30 is 3.0 volts. Moreover, the golf ball impact detection system 10 can be easily carried. Such a golf ball impact detection system 10 has a size of about 1 inch (2.54 cm) by 2.5 inches (6.35 cm) by 0.5 inch (1.77 cm), and weighs about 0.6 ounces (17.01 g). Further, in another embodiment of the present invention, the light source 14 is contained within a housing separate from the protective housing 32 surrounding the sound detection means 42, the integrated circuit chip 20, and the associated electrical components 16, 18, 22, 26.

The present invention provides advantages of comprising a simple system which detects the impact sound of a club head with a golf ball. Upon detection of such impact sound, the system of the present invention illuminates a light source which helps the golfer maintain his focus at the point of contact between the club head and golf ball. Such a system is inexpensive, easily carried, and simple to manufacture. Moreover, the present invention does not require attaching said detection system to the golfer, wherein the weight or placement of such attachment may be distracting for the golfer.

While the invention has been described in detail with reference to the preferred embodiments thereof, it will be apparent to one skilled in the art that various changes and modifications can be made and equivalents employed, without departing from the present invention. For example, while the example of golf was used throughout the above discussion, it is to be understood that the scope of the present invention is not to be limited thereby. It will be readily seen that the impact detection system may be readily adapted to many sporting and other activities wherein the person performing the physical activity will keep his eyes focused on the club, bat, or racquet while making contact with a ball.

What is claimed is:

1. A golf ball impact detection system to assist a golfer in reducing premature head-up movement, the golf impact detection system comprising:

a sound detection means for detecting sound caused by an impact of a club head with a golf ball;

a light source;

a signal amplification means connected to the sound detection means and the light source, such that when the detected sound level is above a predetermined level, the means for detecting said sound level causes the light source to turn on; and means for determining the on-time of the light source when the detected sound level is above the predetermined level, which encourages a golfer to keep his head down while swinging the club head by waiting to see said light source turn on and then turn off.

2. The golf ball impact detection system of claim 1, further comprising:

means for varying the intensity of the light source when said light source is turned on.

3. The golf ball impact detection system of claim 2, wherein the means for varying the intensity of the light source affects the on-time of the light source.

4. The golf ball impact detection system of claim 1, further comprising:

means for varying the audio sensitivity of the sound detection means.

5. The golf ball impact detection system of claim 4, wherein the means for varying the audio sensitivity of the sound detection means can distinguish the impact sound of a putter club head striking a golf ball from a driver or iron club head against said golf ball.

6. The golf ball impact detection system of claim 4, wherein the means for varying the audio sensitivity of the sound detection means comprises a double-pole, triple throw switch.

7. The golf ball impact detection system of claim 1, wherein the sound detection means comprises a microphone.

8. The golf ball impact detection system of claim 7, wherein in operation, when the microphone detects the sound caused by the impact of the club head with the golf ball, the microphone generates an electrical signal which is amplified with adjustable gain capability.

9. The golf ball impact detection system of claim 1, wherein the means for controlling the on-time of the light source comprises a capacitor, the capacitor discharging when the sound level detected by the sound detector means is above the predetermined level, the capacitor having a voltage decay rate which controls the light source on-time.

10. The golf ball impact detection system of claim 1, wherein the means for controlling the on-time of the light source comprises an electrical counter, such that after the light source turns on, said light source turns off when the electrical counter reaches a predetermined count.

11. The golf ball impact detection system of claim 1, wherein the system is powered by a battery.

12. The golf ball impact detection system of claim 1, wherein the system can be hand-held.

13. The golf ball impact detection system of claim 1, wherein the light source and the sound detection means are contained in separate housings and can be a distance apart.

14. A golf ball impact detection system comprising:

a sound detection means for detecting sound caused by an impact of a club head with a golf ball;

a light source;

a signal amplification means connected to the sound detection means and the light source, such that when the detected sound level is above a predetermined level, the means for detecting said sound level causes the light source to turn on;

means for affecting the audio sensitivity of the sound detection means; and a switch means for both adjusting the audio sensitivity of the sound detection means and for adjusting the on-time of the light source.

15. The golf ball impact detection system of claim 14, wherein the switch means can both adjust the golf ball impact detection system for low audio sensitivity and adjust the light source for a short on-time duration.

16. The golf ball impact detection system of claim 15, wherein the short on-time duration of the light source is in the range of about 0.05 to about 0.2 seconds.

17. The golf ball impact detection system of claim 15, wherein the long on-time duration of the light source is in the range of about 0.2 to about 1.0 seconds.

18. The golf ball impact detection system of claim 14, wherein the switch means can both adjust the golf ball impact detection system for high audio sensitivity and adjust the light source for a long on-time duration.

19. A method of detecting the impact of a club head with a golf ball to assist a golfer in reducing premature head-up movement, the method comprising the steps of:

providing a light source;

providing a sound detector means comprising a microphone, the microphone electrically connected to a signal amplification means; and if the microphone detects the impact sound of a club head with a golf ball, then transmitting a signal from the signal amplification means to the light source whereby said light source turns on and after a predetermined time elapses, the light source turns off such that the golfer is encouraged to keep his head down while swinging the club head by waiting to see said light source turn on and turn off before looking up to see his shot.

20. The method of claim 19, further comprising the step of:

adjusting an on-time light source control, connected to the signal amplification means, such that if the microphone detects the impact sound of a club head with a golf ball, then the on-time light source control will enable the light source to turn on and turn off for a desired period of time.

21. The method of claim 20, wherein the on-time light source control comprises a capacitor having a voltage decay rate such that when the signal amplification means detects the impact sound of a club head with a golf ball, the capacitor will discharge wherein the light source will turn on and turn off for a desired period of time.

22. The method of claim 20, wherein the on-time light source control comprises a electrical counter wherein after the light source turns on, said light source turns off when the electrical counter reaches a predetermined count.

23. The method of claim 19, further comprising the step of:

adjusting the audio sensitivity of the sound detection means such that said sound detection means can distinguish the impact sound level of a driver club head against the golf ball from a putter club head against said golf ball.

24. The method of claim 23, wherein by adjusting the audio sensitivity of the sound detection means for detecting the sound level of the driver club head with the golf ball, the on-time of the light source is shorter than when the sound detection means is adjusted to detect the sound level of a putter club head with said golf ball.

25. The method of claim 19, further comprising the step of:

adjusting the intensity level of the light source such that said light source will emit a light brighter during the daytime than at nighttime.

26. The method of claim 19, wherein the signal amplification means comprises an integrated circuit chip.

27. A system to assist a user of sports equipment, including, but not limited to, a club, bat, stick, racquet or other such sporting equipment, to keep the user's eyes focused on the sporting equipment while making contact with a ball, comprising:

a sound detection means for detecting sound caused by an impact of sporting equipment with a ball;

a light source;

a signal amplification means connected to the sound detection means and the light source, such that when the detected sound level is above a predetermined level, the sound detection means causes said light source to turn on; and means for controlling the on-time of the light source which encourages the user to keep his head steady while swinging the sporting equipment by waiting to see said light source turn on and then turn off before looking to see his shot.

* * * * *